United States Patent [19]

Chow et al.

[11] Patent Number: 4,534,512

[45] Date of Patent: Aug. 13, 1985

[54] FLUID DISPENSER

[75] Inventors: Ho Chow, River Edge; Sidney J. Goodman, Paramus, both of N.J.

[73] Assignee: Melnor Industries, Inc., Moonachie, N.J.

[21] Appl. No.: 476,997

[22] Filed: Mar. 21, 1983

[51] Int. Cl.[3] ..... B05B 1/12; B05B 1/16

[52] U.S. Cl. ..... 239/394; 222/153; 222/473; 239/480; 239/483; 239/526; 239/574; 251/111; 251/115

[58] Field of Search ..... 239/394, 476, 477–485, 239/525, 526, 569, 574, 583, 586; 222/153, 472–474, 402.14; 251/111, 114, 115, 121, 209, 208, 241, 297

[56] References Cited

U.S. PATENT DOCUMENTS

| | | | |
|---|---|---|---|
| 1,397,867 | 11/1921 | Jones | 251/209 |
| 2,038,508 | 4/1936 | Elliott | 251/114 |
| 2,305,210 | 12/1942 | Wahlin | 239/463 X |
| 2,621,076 | 12/1952 | Barton | 239/480 X |
| 2,790,680 | 4/1957 | Rosholt | 239/394 |
| 3,099,430 | 7/1963 | Jacobsen | 251/208 X |
| 3,146,674 | 9/1964 | Wahlin | 29/558 X |
| 3,433,261 | 3/1969 | Fox | 251/209 X |
| 3,516,611 | 6/1970 | Piggott | 239/394 X |
| 3,711,029 | 1/1973 | Bartlett | 239/394 |
| 3,814,326 | 6/1974 | Bartlett | 239/394 X |
| 3,888,421 | 6/1975 | Chow | 239/526 X |
| 3,982,698 | 9/1976 | Anderson | 239/394 |
| 4,111,368 | 9/1978 | Brehm | 239/394 |

FOREIGN PATENT DOCUMENTS

| | | | |
|---|---|---|---|
| 322899 | 12/1929 | United Kingdom . | |
| 609326 | 9/1948 | United Kingdom | 222/474 |
| 980303 | 1/1965 | United Kingdom . | |
| 1441649 | 7/1976 | United Kingdom . | |

*Primary Examiner*—Andres Kashnikow

*Attorney, Agent, or Firm*—James & Franklin

[57] ABSTRACT

A fluid dispenser, preferably a pistol grip type hose nozzle, affords no flow, solid misty cone spray and solid jet spray capabilities and contains a fluid flow rate control feature for instantaneous adjustment of the rate of fluid flow through the dispenser.

21 Claims, 12 Drawing Figures

FLUID DISPENSER

BACKGROUND OF THE INVENTION

The present invention relates to fluid dispensers and, more particularly, to a pistol grip type hose nozzle having various modes of operation and a water saving feature.

Periodic water shortages and the ever-increasing cost of water require that hose nozzles be capable of operation at less than the maximum possible fluid flow rate. In a gun or pistol grip type hose nozzle the inlet or grip portion is roughly perpendicular to the outlet or barrel portion, and a handle pivotally secured to the dispenser body is spring loaded outwardly to a no-flow position and movable therefrom against the spring to a full flow position abutting the grip. Unfortunately, there is an almost irresistible impulse for the user to depress the handle all the way to its grip-abutting full-flow orientation and, indeed, to latch it there. (Otherwise the user's hand quickly tires of its delicate balancing act against the spring tension.) In most of these pistol grip hose nozzles the degree of actuation of the handle not only controls the fluid flow rate, but also the type of flow as well, varying the flow from a jet or mist action of narrow diameter to a cone of wider diameter. In such instances the flow/no-flow positioning of the handle is typically dictated by the type of flow desired. While the fluid flow rate through the nozzle can be adjusted by adjusting the water pressure at the source (that is, typically, the faucet), the typical user may not resort to this if it is inconvenient—for example, when the faucet is at the side of the house and the user is at the far end of his lawn. Furthermore, even when the user decides to reduce the pressure at the source, the adjustment is delayed until the user can traverse whatever distance exists between the fluid dispenser and the fluid source. Thus there is a strong need for a nozzle which permits the user to adjust the fluid flow rate through the nozzle immediately, by adjustment of the nozzle itself (and not the fluid source), and without affecting the type of flow (jet or cone) emanating even when the handle is locked in the full flow position.

In conventional pistol grip type fluid control devices of the type illustrated in U.S. Pat. No. 3,888,421, issued June 10, 1975, the fluid spray pattern emerging therefrom is varied from a cone spray to a jet spray by the interaction of a spray head or deflector with the nozzle. Depending upon the relative positioning of the spray head in or about the nozzle, the water passing about the spray head is hollowed out or deflected into either a hollow jet spray or a hollow conical spray, with the water in each case being at the outside surface of the spray and the inside thereof being dry. The non-uniformity of the hollow sprays results ultimately in a waste of water as the user must go over the same general area several times in order to ensure that it has been fully moistened. Furthermore, a hollow spray does not have the carrying power or range of a solid spray. Thus the need exists for a fluid dispenser which can deliver no-flow, variable angle solid conical spray or a solid jet spray, as desired, thereby to avoid the waste of water and provide a greater range for the spray.

While the latch means conventionally used to lock the handle in the full flow or open position operates satisfactorily, it is generally a separate and independent piece (typically a U-shaped metal latch) pivotally fastened to the main sprinkler body. The use of a special part and the need for assembly thereof with the main sprinkler body increase the overall cost of manufacture and assembly of the sprinkler.

Accordingly, it is an object of the present invention to provide a fluid dispenser offering no flow, solid cone sprays and solid jet spray capabilities.

Another object is to provide a fluid dispenser having means therein for easily and immediately adjusting the rate of fluid flow therethrough independent of selecting the spray pattern thereof.

A further object is to provide a fluid dispenser having means for locking the handle in a full open position, the locking means and the main sprinkler body being of integral one-piece construction to reduce manufacturing and assembly costs.

SUMMARY OF THE INVENTION

The above and related objects of the present invention are obtained in a first basic embodiment comprising a fluid dispenser having the capabilities for no flow and first and second spray shapes. The fluid dispenser comprises a dispenser body defining a fluid inlet, a fluid outlet, and an internal passage for a fluid stream. The passage is in fluid communication with the inlet and outlet and defines a wide chamber, a narrow chamber and a valve seat. A piston having spray shaping means and valve body means is movable among no flow and first and second spray shape positions. In the no flow position, the valve body means engages the valve seat to block flow through the passage. In the first spray shape position the valve body means is spaced from the valve seat and the spray shaping means is disposed in the narrow chamber. In the second spray shape position the valve body means is spaced from the valve seat and the spray shaping means is disposed in the wide chamber. Means are operatively connected to the piston for moving the piston among the aforementioned positions. Preferably the first and second shapes are solid cone and solid jet spray shapes, respectively.

In a preferred embodiment, the valve seat is disposed intermediate the wide and narrow chambers and is of intermediate width relative to the wide and narrow chambers. The spray shaping means, disposed in the narrow chamber when the piston is in the no flow position, is disposed adjacent one end of the piston while the valve body means is disposed intermediate the spray shaping means and the other end of the piston. The spray shaping means preferably has an outer surface configured and dimensioned to approximate that of the inner surface of the narrow chamber, while being substantially less than that of the inner surface of the wide chamber. The wide and narrow chambers are longitudinally aligned therewith. Preferably the piston is moved in order to the no flow, solid cone spray and solid jet spray positions, respectively.

Manually operable handle means are operatively connected to the piston-moving means for moving the same. The dispenser body defines a resiliently flexible finger having at the free end thereof latch means for engaging the handle means when the piston is in one of the spray positions, the finger being movable between a first position wherein the latch means engages the handle means to immobilize it against movement in a given direction and a second position where it does not. The dispenser body, the finger and the latch means are all preferably of one piece integral construction. The handle means is also operatively connected to the spray shape means.

In another basic embodiment, the fluid dispenser has an adjustable rate of flow. The dispenser body defines a fluid inlet port, fluid outlet port, and an internal passage communicating between the ports for a fluid stream. The passage has first and second communicating sections defining therebetween an angle through which fluid must pass, the first section defining an aperture leading to the second section. Flow rate control means are disposed in and longitudinally aligned with the second section, the control means being configured and dimensioned to provide a variable length sidewall and being rotatable about its longitudinal axis to cause different portions of the sidewall to abut the aperture. Particular sidewall portions when abutting the aperture restrict fluid flow therethrough to an extent dependent on the length of the particular sidewall portions. Manually operable means are provided for rotating the control means to adjust the dispenser flow rate by causing different particular sidewall portions to abut the aperture.

Preferably the fluid dispensers are pistol grip type dispensers having a grip section corresponding to the first section and a barrel section corresponding to the second section. The sidewall of the flow control means preferably has a V-shaped longitudinal taper, so that a rotation of the flow control means through about 180° effects a maximum change in the flow rate through the aperture.

In a preferred embodiment, the fluid dispenser not only has the adjustable rate of flow feature but also the no flow, and first and second flow shape capabilities. The piston of the dispenser has a first portion thereof disposed within the internal passage of the barrel and a second portion projecting therefrom with abutment means adjustably positioned along the longitudinal length of the exposed second portion of the piston for abutment by the handle means. The abutment means are adjustably positioned along the length of the exposed second portion so that, when the handle is displaced to its open position, the piston is displaced to open the valve means and cause the spray shaping means to produce a spray determined by the position of the abutment means on the piston.

In a third basic embodiment of the present invention, the fluid dispenser is a turret-type sprayer having a turret divided into a plurality of different sections. The turret, with its plurality of different sections, is mounted on the sprayer body adjacent the outlet port and rotatable to bring different ones of the sections into alignment with the outlet port, at least one of the sections being adapted to modify the flow of fluid from the outlet as it passes through that one section. A gasket is disposed about the outlet port, and retaining means are secured to the sprayer body adjacent the outlet to trap the gasket intermediate the outlet port and the turret to preclude leakage intermediate the outlet port and the turret.

DETAILED DESCRIPTION OF THE PREFERRED EMBODIMENTS

Figure 1:
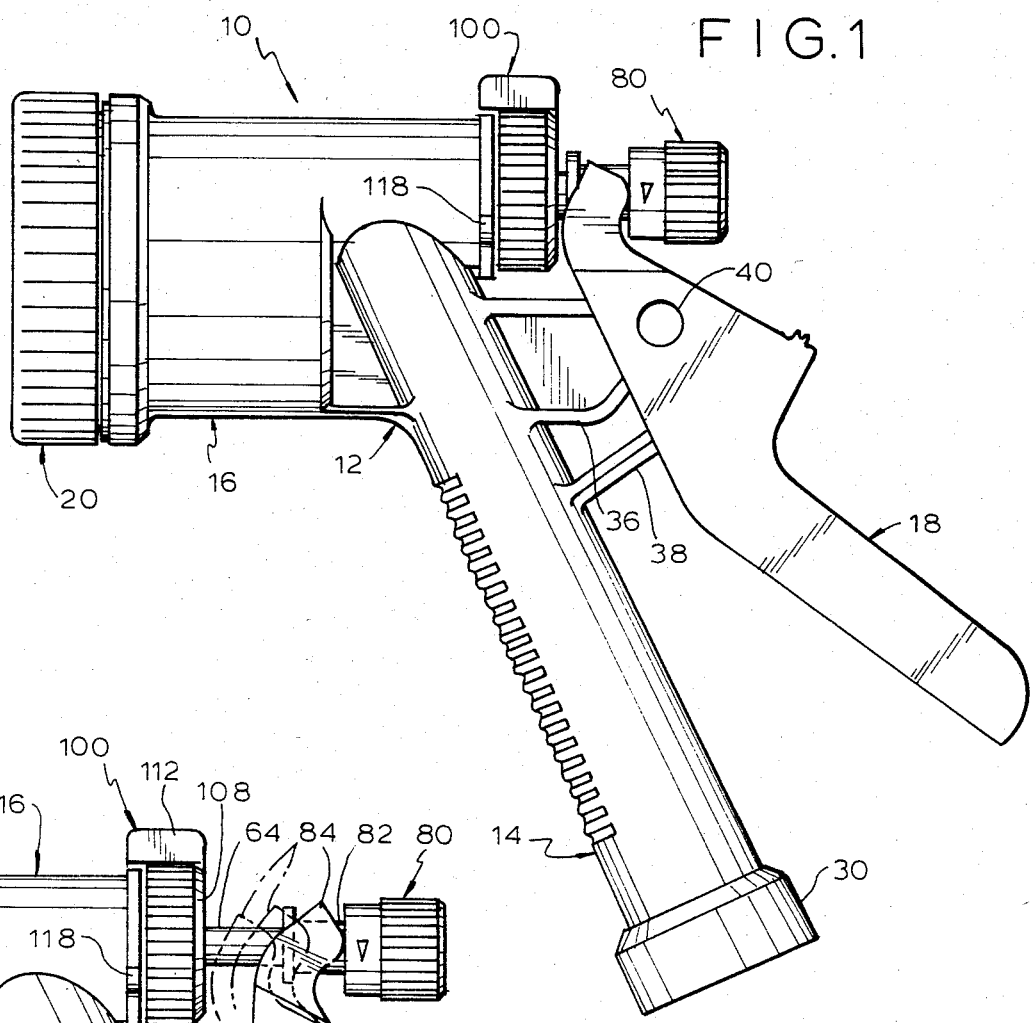
FIG. 1 is a side elevation view of a hose nozzle according to the present invention.

Referring now to the drawing, and in particular to FIG. 1 thereof, therein illustrated is a gun or pistol grip type hose nozzle generally designated by the numeral 10. Broadly speaking, the hose nozzle body 12 is comprised of a grip generally designated by the numeral 14 and a barrel generally designated by the numeral 16, the grip and barrel 14, 16 generally being disposed at a slightly obtuse angle as illustrated. A handle, generally designated by the numeral 18, is pivotally mounted on the hose nozzle body 12 and adapted for movement between a no flow position (illustrated in FIG. 1 and in phantom line in FIG. 5), wherein the forward surface of the bottom of the handle is spaced as far as possible from the rear surface of the bottom of the grip 14, and a full open position (illustrated in solid line in FIG. 5), wherein the forward surface of the bottom of the handle is as close as possible to the rear surface of the bottom of the grip 14. Under appropriate circumstances, as indicated hereinbelow, movement of the handle 18 from the no flow to the full open position varies the operation of the hose nozzle 10 from a no flow condition, through variable misty conical sprays, to a jet spray. In order to enable the hose nozzle to have the capacity for additional modes of operation, as an optional feature a turret 20 may be disposed at the front of the barrel 16, the turret 20 being rotatable relative to the barrel 16 to provide a soft delicate spray suitable for watering flowers or a thin flat spray suitable for washing down driveways, alleys and the like (see FIG. 3).

Figure 5:
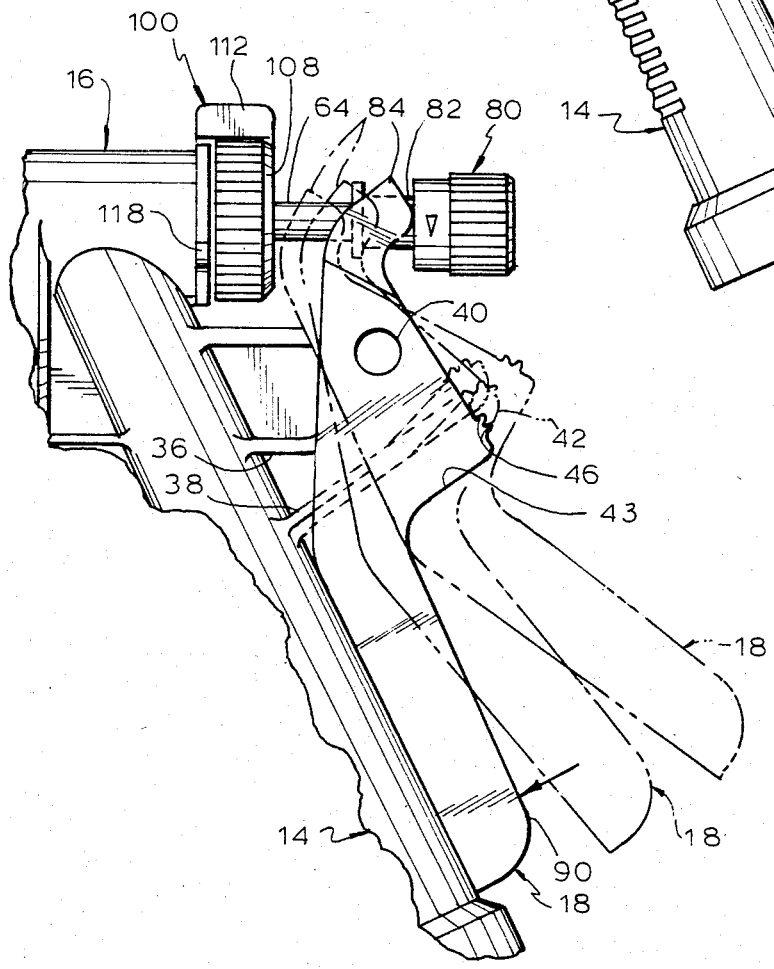
FIG. 5 is a fragmentary side elevation view of the hose nozzle of FIG. 1, but with the handle being shown in a full open position.
Figure 2:
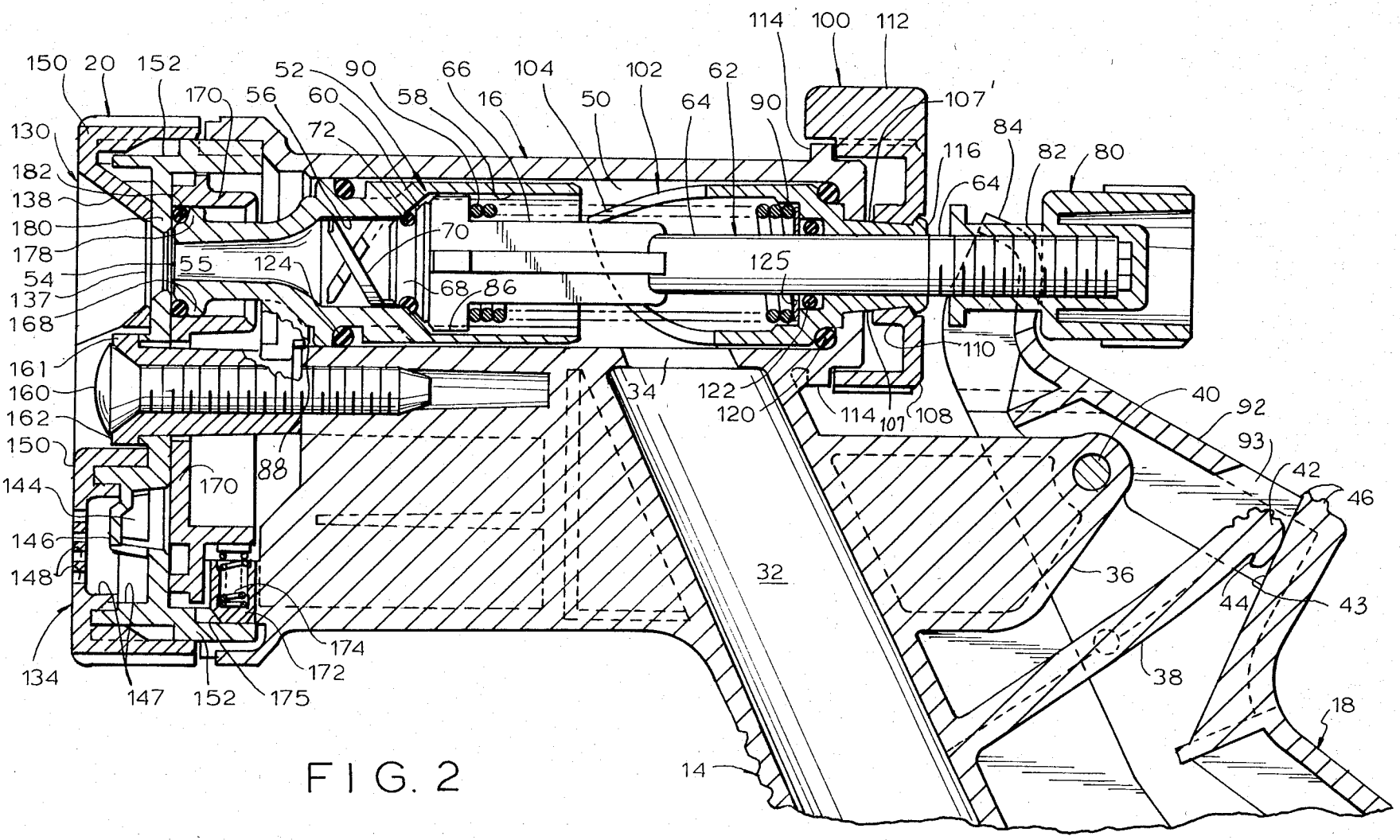
FIG. 2 is a fragmentary side elevation view, to an enlarged scale, of a section of the hose nozzle of FIG. 1.

Turning now to the details of the sprinkler body, and referring to FIGS. 1, 2 and 5 in particular, the base 30 of the grip 14 is internally threaded or otherwise adapted for attachment to a water source such as a hose. If desired, a conventional filter washer (not shown) may be disposed in the base 30, and the front external surface of the grip 14 may be knurled to facilitate handling. The grip 14 provides an internal fluid passage 32 extending from the base 30 to a restricted passage 34 at the top of the grip 14.

Extending generally rearwardly from the rear surface of the grip 14 are a rigid arm 36 and, therebelow, a resiliently flexible finger 38. The arm 36 is adapted to receive therethrough a rivet 40 which secures the handle 18 to the hose nozzle body 12 and serves as a pivotal axis for the handle 18. The top and rear surfaces of the free tip 42 of the finger 38 are knurled to facilitate grasping by the user, while the bottom thereof is configured to cam upon an abutment surface 43 of the handle 18 as the handle is moved from the no flow to full open position. The free tip bottom is further provided with an undercut 44 which cooperates with ridges 46 on the rear surface of the handle 18 when the handle is in the full open position to maintain the handle in that full open position.

The barrel 16 defines an internal fluid passage 50 in fluid communication with the grip fluid passage 32 through the common aperture 34. Disposed within the barrel 16 and longitudinally aligned therewith is a nozzle body, generally designated by the numeral 52, comprising in turn from the front thereof to the rear thereof: a nozzle 54, a tapered outlet chamber 55, a narrow chamber 56 and a wide chamber 58. The narrow and wide chambers 56 and 58 have cylindrical interior surfaces, the interior surface of the nozzle body 52 tapering outwardly as it progresses from the narrow chamber 56 to the wide chamber 58, the tapering portion forming a valve seat 60.

Figure 12:
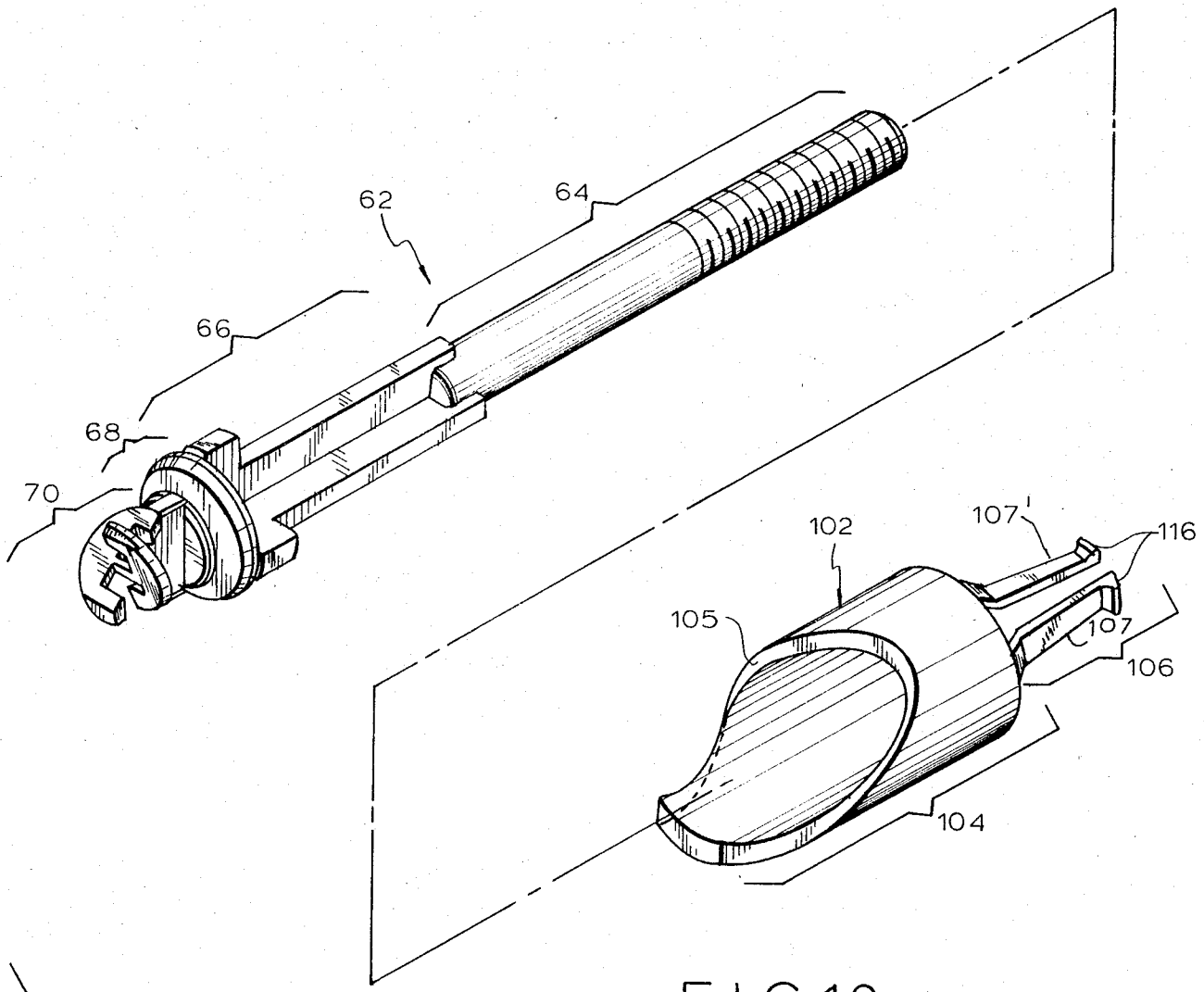
FIG. 12 is an exploded isometric view of the piston and the fluid flow rate control valve.

Referring now to FIGS. 2 and 12 in particular, a plunger or piston, generally designated by the numeral 62, is longitudinally aligned with the barrel 16 and nozzle body 52. The piston 62 includes in order from the rear thereof to the front thereof: a cylindrical rod 64, the rear portion of which is externally threaded, an intermediate portion 66 composed of four flats and an enlarged head, a valve head portion 68, and a swirler 70.

Figure 10:
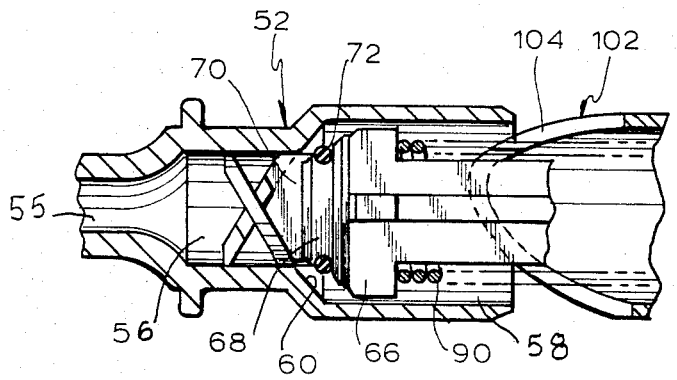
Figure 11:
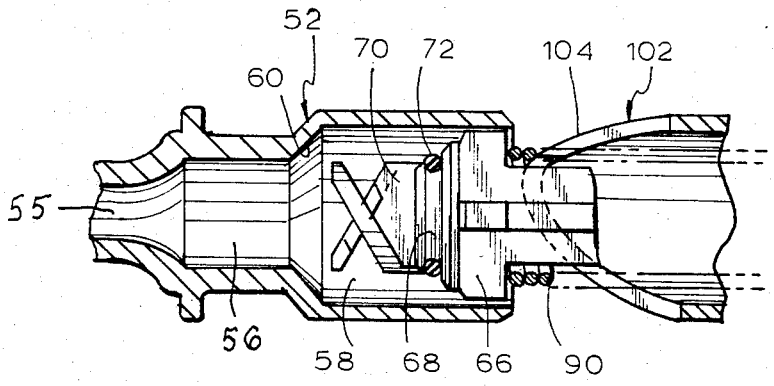

More particularly, the swirler 70 is of conventional swirler design as exemplified in U.S. Pat. Nos. 2,305,210 and 3,146,674. As illustrated in FIG. 10, the outer dimensions of the swirler 70 approximate the inner dimensions of the narrow chamber 56, so that, while the swirler 70 is disposed within the narrow chamber 56, the fluid stream passing through the narrow chamber 56 must pass through the swirler which imparts to it a swirling action so that a solid misty conical spray is emitted from the nozzle 54. On the other hand, when the swirler 70 is disposed within the wide chamber 58, as illustrated in FIG. 11, the fluid stream passing through the wide chamber tends to follow the path of least resistance and thus flows about the swirler 70 rather than through it. Nonetheless, the fluid stream emerges from the nozzle 54 as a solid jet because any hollowing action resulting from the swirler 70 or valve seat 68 has an opportunity to dissipate during the length of the passage of the fluid stream from such pieces through the chambers 56 and 55 to the nozzle 54.

Figure 9:
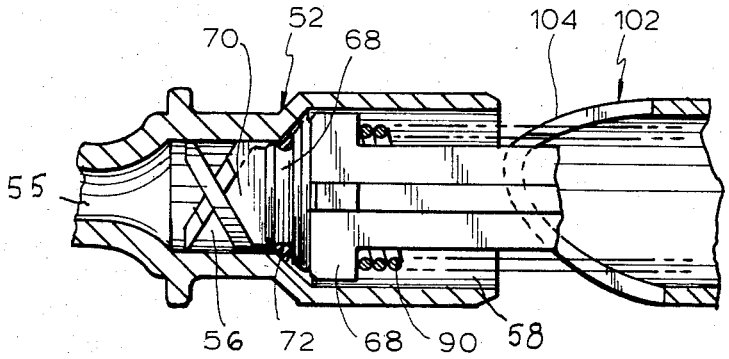
FIGS. 9, 10 and 11 are fragmentary side elevation views, in section, showing the piston means within the chambers of the barrel in the no flow, misty conical spray and jet spray positions, respectively.

The valve head 68 has a front portion adapted to fit within the narrow chamber 56, a rear portion which flares outwardly in a manner similar to the valve seat 60 and, intermediate the front and rear portions a groove adapted to receive a gasket or o-ring 72 for insuring a fluid-tight seal between the valve head 68 and the valve seat 60 when the piston 62 is in the no flow position, as illustrated in FIGS. 2 and 9.

As illustrated in FIGS. 1–2 and 5–7 in particular, an externally knurled and internally threaded jet-to-cone spray adjustment knob, generally designated by the numeral 80 and longitudinally aligned with piston 62, threadingly engages the threaded end of piston rod 64 projecting from the rear of the barrel 16. The adjustment knob 80 defines a longitudinal portion 82 of restricted diameter relative to the abutment surfaces on either side thereof. The restricted knob length 82 is adapted to fit within an opentop slot at the top 84 of the handle 18 so that the handle top 84 is capable of moving the adjustment knob 80, and hence the piston 62, in either direction along its longitudinal axis.

The handle, generally designated by the numeral 18, comprises a lower portion adapted to be grasped by the user's palm in moving the handle from its no flow position towards the grip 14, an intermediate section 92 which is pivotally secured to the grip arm 36 by a peened-over rivet 40, and the aforementioned upper portion or top 84 which is disposed at least partially within and about the knob groove 82.

Figure 6:
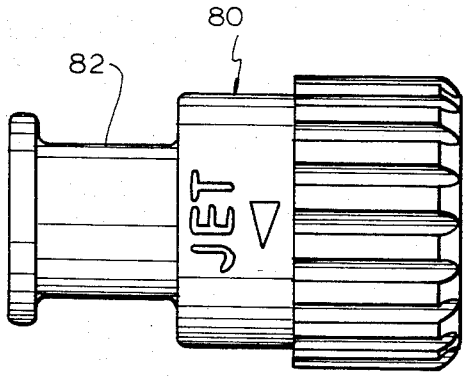
FIGS. 6 and 7 are side elevation views of opposite sides of the adjustment knob.
Figure 7:
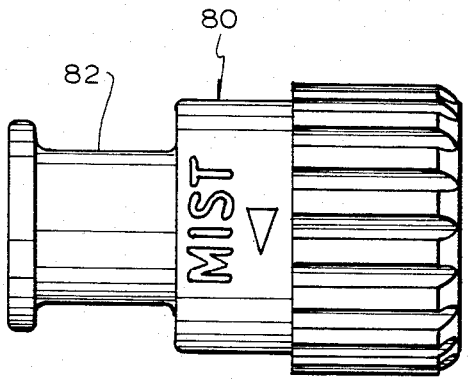

The configuration of the handle 18 and the lengths of the threaded portions of the piston 62 and knob 80 are selected so that, when the knob 80 is just barely threaded onto the piston 62, the effective length of the piston/knob combination is such that movement of the handle 18 from its no flow position to its full open position causes the valve head 68 and O-ring 72 to retreat from the valve seat 60, with the swirler 70 being displaced, but still effectively disposed in the narrow chamber 56 and thus effecting a misty conical spray with a wide conical angle (as illustrated in FIG. 10). On the other hand, when the knob 80 is fully threaded onto the piston 62, the effective length of the piston/knob combination is reduced so that the same movement of the handle 18 results not only in opening of the valve but also a rearward displacement of the swirler 70 from the narrow chamber 56, through the valve seat 60 into the wide chamber 58, thereby effecting a jet spray (as illustrated in FIG. 11). As the spray changes from a misty cone to a jet, the very wide initial angle formed by the sides of the cone diminishes until the sides are parallel—that is, until the spray is a jet. Thus it should be appreciated that while the handle 18 is in the full open position, the emerging spray may be either a jet or a misty cone of various conical angles, depending upon the degree to which the knob 80 is threaded onto the rod 64. Accordingly, as illustrated in FIGS. 6 and 7 in particular, opposite sides of the knob 80 are provided with appropriate indicia and an arrow indicating the direction of rotation for the desired spray when handle 18 is in its full open position. Clearly the longitudinal distance traveled by knob 80 as it is threaded onto the piston 62, as the knob goes from its largest conical spray to its jet spray orientation, must be equal to the longitudinal distance which the swirler 70 travels as it passes from its largest conical spray position in the narrow chamber 56 (see FIG. 10) to its jet spray position in the wide chamber 58 (see FIG. 11)

In order to preclude rotation of the piston 62 and/or nozzle body 52 with the adjustment knob 80, the piston 62 is keyed to the nozzle body 52 as shown at 86 and the nozzle body 52 is keyed in turn to the barrel 16 as shown at 88.

In order to bias the piston 62, and thus the handle 18, to its no flow position, a helical compression spring 90 is disposed in the fluid passage 50 of the barrel 16. The spring 90 is longitudinally aligned with and disposed about the piston 62, the forward end of the spring 90 surrounding the four flats of the intermediate portion 66 and pressing against the head formed thereby, while the rear end of the spring 90 operatively abuts the rear of the barrel 16.

Figure 4:
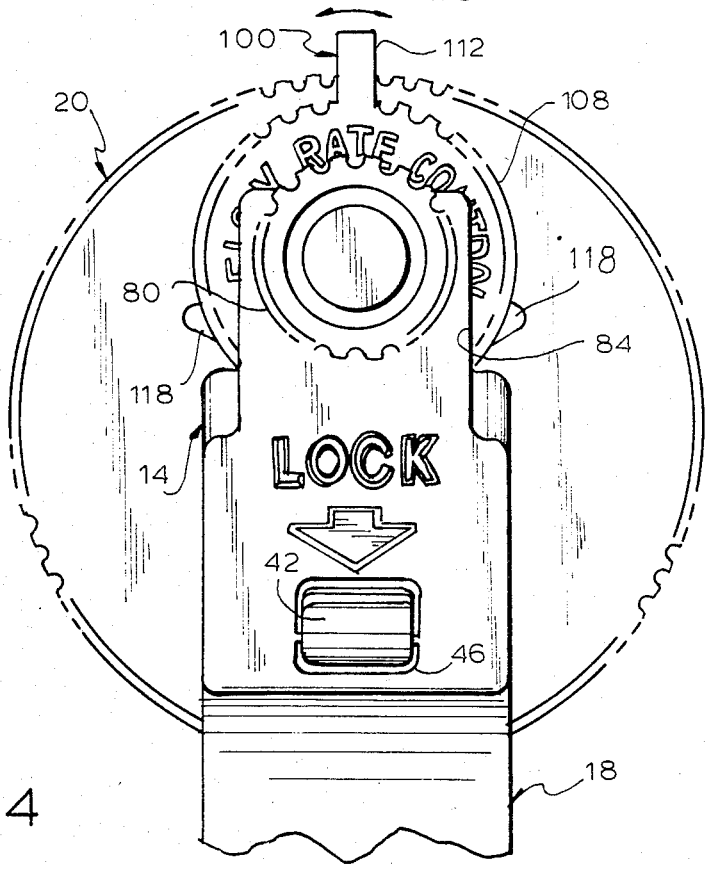
FIG. 4 is a rear elevation view, to an enlarged scale, of the hose nozzle.

Referring now to FIGS. 2 and 4–5 in particular, the handle 18 is provided with an aperture 93 in order to enable the free tip 42 of the resilient finger 38 to pass therethrough as the forward surface of the bottom portion 90 of the handle 18 is brought towards the rear surface of the bottom of the grip 14. In order to facilitate passage of the finger tip 42 through the aperture 93, the interior surface of the handle defines an appropriate cam surface 43 for the bottom of the finger tip 42. When the handle 18 is pivoted slightly past the full open position, further towards the grip 14, the finger tip 42 projects through the rear of aperture 93 and may be depressed or bent over, as shown by appropriate indicia and an arrow on the handle 18 thereabove, in order to cause interlocking of ridges 46 and undercut 44 so that the finger tip 42 locks the handle 18 in the full open position or substantially close thereto, as illustrated in FIGS. 4 and 5, upon release of manual pressure on the handle. When it is desired to release the handle 18 from its locked full open position, the handle is again pivoted slightly past its full open position, further towards the grip 14, at which point the resilient finger tip 42 springs upwardly to release the engagement between the undercut 44 and the ridges 46, thereby permitting the handle 18 to return to the no flow position and the finger tip 42 to retreat through the aperture 93. (If necessary, the finger tip 42 may be pushed away from its locking position to facilitate disengagement of the finger tip 42.) As the finger 38 is of one piece integral construction with the grip 14, there is no separate locking member which must be secured to the hose nozzle body 12 during assembly, thus reducing material and labor costs while at the same time avoiding the possibility of later accidental detachment of any attachable locking piece.

Referring now to FIGS. 2, 4, 8 and 12 in particular, the hose nozzle of the present invention is provided with a flow control feature comprising a flow control dial generally designated by the numeral 100 and a flow control valve generally designated by the numeral 102. The forward portion 104 of the valve 102 is in the configuration of a hollow cylinder from which a segment has been cut so that the forward wall 105 of the cylinder tapers gradually from a minimum length to a maximum length. The valve 102 is axially aligned with and disposed about the piston 62 and spring 90, the valve 102 being rotatable along its longitudinal axis and disposed about the longitudinal axis of the barrel 16 in the region of aperture 34 between the fluid passageways 32 and 50. When the cylindrical sidewall of minimal length is disposed above the aperture 34, the valve 102 presents little, if any, resistance to the flow of fluid through aperture 34. On the other hand, when the valve 102 is rotated so that the sidewall of maximum length is directly atop the aperture 34, the fluid flow through the aperture 34 is substantially impeded. As complete shut-off of the fluid flow can be achieved through use of the handle 18, and the object of the fluid flow control feature is simply to save water while otherwise permitting the hose nozzle to operate effectively, the valve 102 is designed to at most substantially reduce the fluid flow through aperture 34 without entirely eliminating the same. The back portion 105 of the valve 102 is comprised of four longitudinally extending, angularly spaced resilient legs 107 passing through and extending substantially behind the back of barrel 16.

Figure 8:
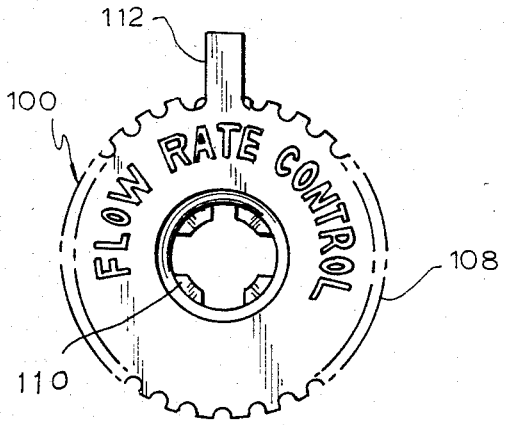
FIG. 8 is a rear elevation view of the fluid flow rate control dial.

The fluid flow control dial 100 comprises an externally knurled, generally cylindrical knob 108 having four circumferentially spaced lugs 110, each extending radially inwardly and adapted to fit between a respective pair of legs 107 of the rear valve portion 106, and a flag 112 extending radially outwardly from the knob 108. The front face of the knob 108 abuts radial flanges 114 provided on the barrel 16, while the rear surface of the knob 108 abuts flanges 116 extending radially outwardly from the rear of the valve legs 107. The engagement of the dial lugs 110 with the valve legs 107 is accomplished prior to the insertion of rod 64 of piston 62 and locks the dial 100 and valve 102 together for rotation as a unit. The two uppermost lugs 110 (as seen in FIG. 8) define a narrow space for the upper leg 107' (as seen in FIG. 2), which leg 107' is narrower than the other legs 107 so that flow control valve 102 and dial 100 can only engage at a definite angular relationship. The dial 100 is easily rotated, either by the knurled knob 108 or by the upstanding flag 112, within an arc defined by a pair of bosses 118 (see FIGS. 1 and 5) disposed on either side of the back of barrel 16 for abutting engagement with the flag 112. For the configuration of the valve illustrated in the drawing, and in particular in FIG. 12, a rotation of about 180 degrees is sufficient to permit a change in the water flow from maximum to minimum flow. Other configurations for the valve 102 may be adopted which permit a maximum change with a rotation of a lesser or greater angle up to 360° (without bosses 118), as desired for a particular application. The dial 100 enables the user to adjust the rate of fluid flow through the aperture 34, and hence through the hose nozzle 10, both instantaneously and without returning to the position of any control device at the fluid source.

In order to prevent fluid leakage from the barrel 16, gaskets or O-rings are provided in strategic places, O-ring 120 between the fluid flow control valve 102 and the rear of the barrel 16; O-ring 122 between the rod 64 and the valve 102, and O-ring 124 between the nozzle body 52 and the barrel 16. In order to retain O-ring 122, a washer 125 is provided and held against valve 102 by spring 90.

Figure 3:
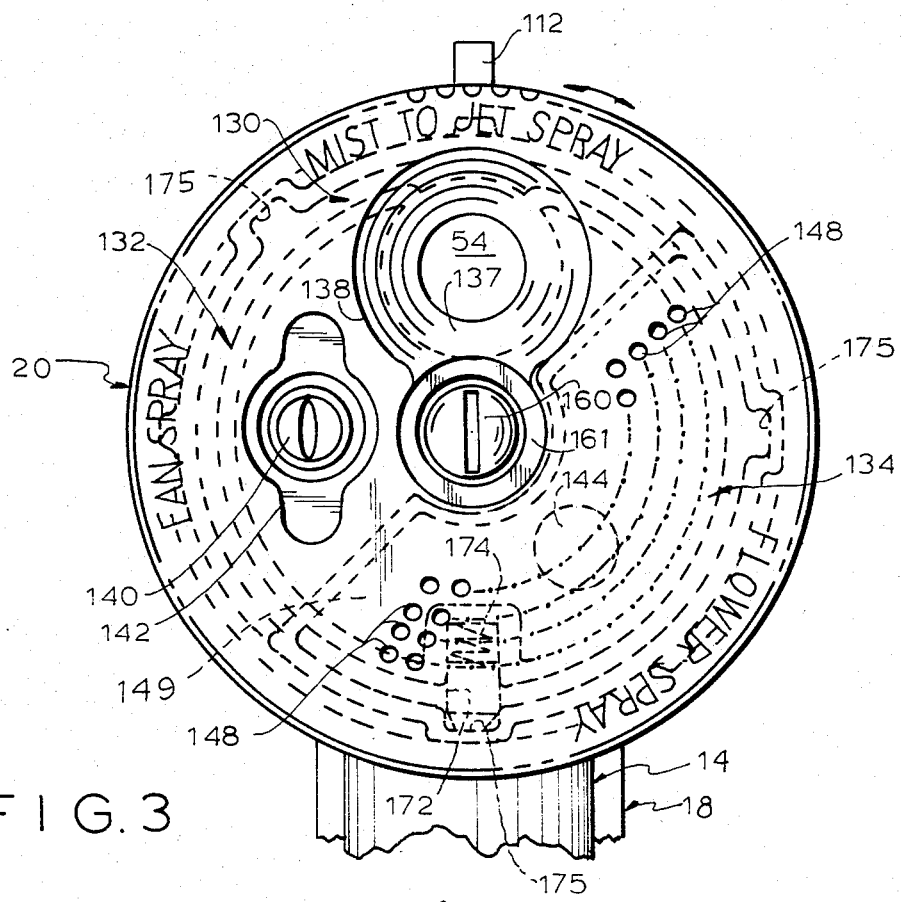
FIG. 3 is a fragmentary front elevation view, to an enlarged scale, of the hose nozzle.

Referring now to FIGS. 1–4 in particular, in order to provide a selection of sprays in addition to the jet-to-cone variety, the hose nozzle may optionally be provided with a turret generally designated by the numeral 20. As illustrated in FIG. 3, the turret 20 is divided into three segments, a first segment generally designated by the numeral 130 and providing a "mist to jet" spray as described hereinabove, a second segment generally designated by the numeral 132 and providing a flat "fan" spray, and a third segment generally designated by the numeral 134 and providing a soft "flower" spray. The operative portion of the mist to jet spray segment 130 comprises simply a circular aperture 137 and an outwardly tapered aperture sidewall 138 which, when aligned with the nozzle outlet 54, as illustrated in FIG. 2, do not affect the spray emanating therefrom in any substantial fashion, so that even a misty conical spray may be obtained.

Referring now to FIG. 3 in particular for its depiction of the "fan" segment 132, when the turret 20 has been rotated so that the "fan" spray segment 132 is in the upper or operative position, a V-shaped aperture 140 in the rear of the segment 132 is aligned with the nozzle 54, but the sidewalls 142 of the sector about aperture 140 are longitudinally elongated such that only a relatively flat plane of spray emerges from the turret 20. This flat or "fan" spray is ideal for watering narrow areas without wasted overspray and may also be used for washing cars, pavements and driveways with a minimum of overspray waste.

Referring now to FIGS. 2–3 in particular for their depiction of the "flower" segment 134, when the turret 20 is rotated so that the "flower" spray segment 134 is in the upper or operative position, the fluid flow emerging from nozzle 54 passes through a circular aperture 144 into a chamber 148, where it is deflected substantially 90 degrees by a first barrier 146 and then substantially another 90 degrees back by a second barrier 147, before being permitted to emerge in its original direction from a large plurality of small openings 148. The tortuous path which the fluid flow must follow in this turret segment 134 provides uniform flows from openings 148. Due to the many openings 148, the velocity of water flow from each opening is very low, ideal for watering delicate flowers.

The turret 20 comprises a turret housing 150 defining the sidewalls 138, 142 and openings 148, and a turret base 152 defining the apertures 137, 140 and 144, the housing and base being secured together for rotation as a unit. The chamber 149 under turret segment 134 is formed by joining turret housing 150 and turret base 152 to form a sealed chamber except for water ingress aperture 144 and water egress openings 148. The turret 20 is secured to the hose nozzle body 12 (and in particular the barrel 16) by a self-tapping mounting screw 160 which engages a post or bushing 161 of the hose nozzle body having a shoulder 162 which traps an abutting portion of the turret base 152.

Trapped between the turret 20 and the barrel 16 is a stationary retainer 170 carrying, adjacent to the bottom of the barrel 16, a pin 172 biased downwardly by a pin spring 174. The bottom surface of the pin 172 is tapered inwardly and adapted to engage one of three depressions 175 in the turret base 152 to lock the turret in one of its three positions against accidental displacement, while permitting intentional manual rotation of the turret 20. Above the axis of rotation of the turret 20, the retainer 170 cooperates with an outwardly extending flange 178 on the nozzle 54 and inwardly extending flange 180 of the turret base 152 to maintain a gasket or O-ring 182 trapped against the outer surface of the nozzle 54. The critical trapping of the O-ring 182, intermediate the flanges 178, 180 and intermediate the retainer 170 and nozzle 54, prevents the fluid emerging from nozzle 54 from escaping sideways through the gaps between the turret base 152 and the nozzle 54. When the piston is in the no flow position, spring 90 assists in this function by urging nozzle 54 forwardly (via valve seat 60); when the piston is in a spray shaping position; the hydraulic pressure of the fluid in barrel fluid passage 50 assists in like manner.

The entire hose nozzle 10, with the exception of the rubber gaskets, metal springs and certain fasteners (such as rivets and screws), may be made exclusively of plastic to provide a sturdy, but economical piece of garden equipment.

To use the hose nozzle, after the base 30 thereof has been secured to a fluid source such as a hose (not shown), the user first determines the type of spray desired and then, if necessary, rotates the turret 20 so as to bring it into the upper or operative position wherein the inlet of the segment is in fluid communication with the nozzle 54. Normal force applied to the turret 20 will be sufficient to overcome the weak detaining action of the biased positioning pin 172, which will return to its extended position when the new segment 130, 132 or 134 is in place.

The mist or jet setting of the spray adjustment knob 80 has little effect on the spray emanating from the hose nozzle when the "fan" or "flower" segments 132, 134 are operative. Hence no adjustment of the knob need by made if one of these sprays is desired. On the other hand, when the "mist to jet" segment 130 is in the operative position, the user rotates the knob 80, if necessary, in an appropriate direction (as indicated by the indicia thereon) so as to achieve the desired spray shape. Rotation of the knob 80 changes the effective length of the piston/knob combination so that, when the handle 18 is depressed to its full open position, the valve head 68 and O-ring 72 retreat from the valve seat 60 and—dependent on the setting of knob 80—the swirler 70 is displaced inside the narrow chamber 56 for mist sprays of various cone angles or into the wide chamber 58 for a jet spray.

Regardless of the turret segment selected, the fluid flow control dial 100 may be rotated within the limits of bosses 118 in order to adjust the flow rate of the fluid passing from grip internal passage 32 into barrel internal passage 50 via the aperture 34. Rotation of the dial 100 by means of flag 112 varies the length of the sidewall of valve 102 presented to the aperture 34 and thereby varies the fluid flow resistance to the water seeking to pass through aperture 34 so as to achieve the desired flow rate.

It will be appreciated that optimally the turret 20, the spray adjustment knob 80, and the fluid flow control dial 100 are each suitably adjusted before the handle is moved off the no flow position, thereby to ensure that the emerging flow is initially in the desired pattern and at the desired flow level. Each may be readjusted later, even while the handle is in the full open position, and, if desired, the initial adjustments may be dispensed with and adjustments made only on the fly (that is, after fluid flow has begun).

Movement of the handle 18 to its full open position causes the finger tip 42 cam along the handle surface 43 and pass through aperture 93 as the handle top 84 disposed in knob groove 82 pushes the piston/knob combination rearwardly to the jet or mist spray position as determined by the setting of knob 80. If the user wishes the full open position of the handle to be maintained automatically, the handle need only be pivoted beyond the full open position, further towards the grip, to enable the free finger tip 42 to be brought into play by bending finger 38 downwardly, thereby to cause locking engagement of the undercut 44 thereof with the ridges 46 on the back of the handle. Upon the release of the handle at the same time, the handle will be retained in the full open position by finger 38. To enable the handle to return to its no flow position (or any position intermediate its no flow and open positions), the user has only to again pivot the handle to beyond the full open position and then release the handle, thereby permitting the finger 38 to move back to its natural nonlocking position automatically.

To summarize, the present invention provides a fluid dispenser, having no flow, various solid misty cone spray and solid jet spray capabilities as well as an instantaneously adjustable and conveniently used fluid flow control feature. Furthermore, the fluid dispenser incorporates means for retaining itself in a full flow mode of operation without any separate latch mechanism, thereby reducing the cost of materials as well as the cost of assembly labor. The fluid dispenser further provides novel means for maintaining a gasket intermediate the turret and hose nozzle, thereby to preclude leakage of fluid therebetween.

While the present invention has been described and illustrated in terms of the gun type hose nozzle of the type commonly used in gardens and lawns, clearly the principles of the present invention have equal applicability in other fields using different types of fluid dispensers for liquid and gas.

Now that the preferred embodiments of the present invention have been shown and described in detail, various modifications and improvements thereon will become readily apparent to those skilled in the art. Accordingly, the spirit and scope of the present invention is to be limited only by the appended claims, and not by the foregoing disclosure.

We claim:

1. A fluid dispenser having capabilities for no flow and first and second spray shapes comprising:

(A) a dispenser body defining a fluid inlet, a fluid outlet, and an internal passage for a fluid stream, said passage being in fluid communication with said inlet and outlet and defining a wide chamber, a narrow chamber and a valve seat, said valve seat being disposed intermediate said wide and narrow chambers and tapering from the diameter of said wide chamber to the diameter of said narrow chamber;

(B) a piston having spray shaping means and valve body means, said piston being movable among no flow and first and second solid spray shape positions, (1) in said no flow position said valve body means engaging said valve seat to block flow through said passage and said spray shaping means being in said narrow chamber;

(2) in said first spray shape position said valve body means being spaced from said valve seat and said spray shaping means being disposed in said narrow chamber; and (3) in said second spray shape position said valve body means being spaced from said valve seat and said spray shaping means being disposed in said wide chamber; and (C) means operatively connected to said piston for moving said piston among said positions.

2. The dispenser of claim 1 wherein said first and second shapes are solid cone and solid jet spray nozzles, respectively.

3. The dispenser of claim 2 wherein said piston is movable in order through said no flow position, a plurality of said solid cone spray positions and said solid jet spray position, respectively.

4. The dispenser of claim 1 wherein said piston has first and second ends, said spray shaping means being disposed adjacent said first end and said valve body means being disposed intermediate said spray shaping means and said second end.

5. The dispenser of claim 1 wherein the outer surface of said spray shaping means is configured and dimensioned to approximate the inner surface of said narrow chamber and be substantially less than the inner surface of said wide chamber.

6. The dispenser of claim 1 wherein said wide and narrow chambers are longitudinally aligned.

7. The dispenser of claim 6 wherein said piston is longitudinally aligned with said chambers and said outlet.

8. The dispenser of claim 1 wherein said dispenser is a pistol-grip type hose nozzle, and said passage is substantially water-tight intermediate said inlet and outlet.

9. The dispenser of claim 1 having an adjustable rate of flow and wherein said internal passage for a fluid stream has first and second communicating sections defining therebetween an appreciable angle through which fluid must pass, said first section defining an aperture leading to said second section, said dispenser further comprising fluid flow rate control means disposed in and longitudinally aligned with said second section, said control means being configured and dimensioned to provide a longitudinally tapered sidewall and being rotatable about its longitudinal axis to cause different portions of said sidewall to abut said aperture, particular sidewall portions when abutting said aperture restricting fluid flow therethrough to an extent dependent on the length of said particular sidewall portions, and manually operable means for rotating said controls means to adjust the dispenser flow rate by causing different particular sidewall portions to abut said aperture.

10. The dispenser of claim 9 wherein said dispenser is a pistol grip type dispenser having a barrel section and a grip section, said first and second sections comprising said grip and barrel sections, respectively.

11. The dispenser of claim 1 further comprising a turret divided into a plurality of different sections, said turret being mounted on said dispenser body adjacent said outlet and manually rotatable to bring different ones of said sections into alignment with said outlet, at least one of said sections being adapted to modify the flow of fluid from said outlet as it passes through said one section; a gasket disposed about said outlet and abutting said turret; and retaining means secured to said dispenser body and cooperating with said outlet and said turret to retain said gasket in a position to preclude the accidental leakage of fluid intermediate said turret and said outlet.

12. The dispenser of claim 11 wherein said turret is at all times rotatable relative to said dispenser body.

13. The dispenser of claim 1 wherein said valve seat and said valve body means together comprise valve means for closing said internal passage of said dispenser body, said dispenser additionally including manually operable handle means operatively connected to said valve means for opening and closing said valve means.

14. The dispenser of claim 13 wherein said spray shaping means is disposed in said internal passage, said handle means further being operatively connected to said spray shaping means for causing said spray shaping means to change the shape of the spray.

15. The dispenser of claim 14 wherein said piston has a first portion disposed within said internal passage and a second portion projecting therefrom, said dispenser additionally comprising abutment means adjustably positioned along the longitudinal length of the exposed second portion for abutment by said handle means.

16. The dispenser of claim 15 wherein said abutment means may be adjustably positioned along the length of the exposed second portion so that, when said handle means is displaced to the maximum, said piston is displaced to open said valve means and cause said spray shaping means to produce a spray determined by the position of the abutment means on said piston.

17. A fluid dispenser having capabilities for no flow and first and second spray shapes comprising:

(A) a dispenser body defining a fluid inlet, a fluid outlet, and an internal passage for a fluid stream, said passage being in fluid communication with said inlet and outlet and defining a wide chamber, a narrow chamber and a valve seat;

(B) a piston having spray shaping means and valve body means, said piston being movable among no flow and first and second solid spray shape positions, (1) in said no flow position said valve body means engaging said valve seat to block flow through said passage;

(2) in said first spray shape position said valve body means being spaced from said valve seat and said spray shaping means being disposed in said narrow chamber; and (3) in said second spray shape position said valve body means being spaced from said valve seat and said spray shaping means being disposed in said wide chamber;

(C) means operatively connected to said piston for moving said piston among said positions; and (D) manually operable handle means operatively connected to said piston-moving means for moving same;

said dispenser body further defining a resiliently flexible finger having at the free end thereof latch means for engaging said handle means when said piston is in one of said spray positions, said finger being movable between a first position wherein said latch means engages said handle means to immobilize it against movement in a given direction and a second position wherein it does not, said dispenser body, said finger and said latch means being of one-piece integral construction.

18. The dispenser of claim 17 wherein said dispenser body is formed of plastic.

19. The dispenser of claim 17 wherein said first and second spray shapes are solid cone and solid jet sprays, respectively.

20. The dispenser of claim 19 wherein said valve seat is disposed intermediate said wide and narrow chambers and is intermediate in width relative to said wide and narrow chambers, said piston having first and second opposite ends with said valve body means being disposed intermediate said spray shaping means and said second end, the width of said spray shaping means approximating that of said narrow chamber and being substantially less than that of said wide chamber; said wide chamber, said narrow chamber, said outlet and said piston all being longitudinally aligned, whereby said piston is movable in order through said no flow, solid cone spray and solid jet spray positions, respectively.

21. A fluid dispenser having capabilities for no flow and first and second spray shapes comprising:

(A) a dispenser body defining a fluid inlet, a fluid outlet, and an internal passage for a fluid stream, said passage being in fluid communication with said inlet and outlet and defining a wide chamber, a narrow chamber and a valve seat;

(B) a piston having spray shaping means and valve body means, said piston being movable among no flow and first and second spray shape positions, (1) in said no flow position said valve body means engaging said valve seat to block flow through said passage;

(2) in said first spray shape position said valve body means being spaced from said valve seat and said spray shaping means being disposed in said narrow chamber; and (3) in said second spray shape position said valve body means being spaced from said valve seat and said spray shaping means being disposed in said wide chamber;

(C) means operatively connected to said piston for moving said piston among said positions; and (D) manually operable handle means operatively connected to said spray shaping means for moving same;

said dispenser body further defining a resiliently flexible finger having a free end with latch means for engaging said handle means when said spray shaping means is in a given position, said finger being movable between a first position wherein said latch means engages said handle means to immobilize it against movement in a given direction and a second position wherein it does not, said dispenser body, said finger and said latch means being of one piece integral construction.

* * * * *